US008038760B1

(12) United States Patent
Shaw et al.

(10) Patent No.: US 8,038,760 B1
(45) Date of Patent: Oct. 18, 2011

(54) MOLYBDENUM/MOLYBDENUM DISULFIDE METAL ARTICLES AND METHODS FOR PRODUCING SAME

(75) Inventors: Matthew C. Shaw, Sahuarita, AZ (US); Carl V. Cox, Sahuarita, AZ (US); Yakov Epshteyn, Sahuarita, AZ (US)

(73) Assignee: Climax Engineered Materials, LLC, Phoenix, AZ (US)

( * ) Notice: Subject to any disclaimer, the term of this patent is extended or adjusted under 35 U.S.C. 154(b) by 0 days.

(21) Appl. No.: 12/833,458

(22) Filed: Jul. 9, 2010

(51) Int. Cl.
*B22F 1/00* (2006.01)
*B22F 3/00* (2006.01)

(52) U.S. Cl. ..... 75/245; 75/231; 75/252; 428/570

(58) Field of Classification Search ..... 75/231, 75/245, 252; 428/570
See application file for complete search history.

(56) References Cited

U.S. PATENT DOCUMENTS 3,479,289 A * 11/1969 Van Wyk ..... 75/231
5,476,632 A 12/1995 Shivanath et al.
5,980,819 A 11/1999 Nakagawa et al.
6,376,103 B1 * 4/2002 Sampath et al. ..... 428/663
6,395,202 B1 5/2002 Nagel et al.
6,623,876 B1 9/2003 Caron
7,553,564 B2 6/2009 Gupta et al.
7,575,619 B2 8/2009 Kawata et al.
2006/0079410 A1 4/2006 Yadav
2007/0054057 A1 3/2007 Matje et al.
2009/0123690 A1 5/2009 Scholl et al.

FOREIGN PATENT DOCUMENTS

JP 10226833 A 8/1997

* cited by examiner

*Primary Examiner* — Roy King
*Assistant Examiner* — Ngoclan Mai
(74) *Attorney, Agent, or Firm* — Fennemore Craig, P.C.

(57) ABSTRACT

A method for producing a metal article according to one embodiment may involve the steps of: Providing a composite metal powder including a substantially homogeneous dispersion of molybdenum and molybdenum disulfide sub-particles that are fused together to form individual particles of the composite metal powder; and compressing the molybdenum/molybdenum disulfide composite metal powder under sufficient pressure to cause the mixture to behave as a nearly solid mass.

18 Claims, 4 Drawing Sheets

MOLYBDENUM/MOLYBDENUM DISULFIDE METAL ARTICLES AND METHODS FOR PRODUCING SAME

TECHNICAL FIELD

This invention relates to metal articles produced from metal powders in general and more specifically to molybdenum metal articles having improved friction and wear characteristics.

BACKGROUND

Molybdenum is a tough, ductile metal that is characterized by moderate hardness, high thermal and electrical conductivity, high resistance to corrosion, low thermal expansion, and low specific heat. Molybdenum also has a high melting point (2610° C.) that is surpassed only by tungsten and tantalum. Molybdenum is used in a wide variety of fields, ranging from aerospace, to nuclear energy, to photovoltaic cell and semiconductor manufacture, just to name a few. Molybdenum is also commonly used as an alloying agent in various types of stainless steels, tool steels, and high-temperature superalloys. In addition, molybdenum is often used as a catalyst (e.g., in petroleum refining), among other applications.

Molybdenum is primarily found in the form of molybdenite ore which contains molybdenum sulfide, ($MoS_2$) and in wulfenite, ($PbMoO_3$). Molybdenum ore may be processed by roasting it to form molybdic oxide ($MoO_3$). Molybdic oxide may be directly combined with other metals, such as steel and iron, to form alloys thereof, although ferromolybdenum (FeMo) also may be used for this purpose. Alternatively, molybdic oxide may be further processed to form molybdenum metal (Mo).

Processes for producing molybdenum metal may be broadly categorized as either two-step reduction processes or single stage reduction processes. In both types of processes, the molybdenum metal is typically recovered in powder form. The starting material may be either oxide or molybdate, the choice being determined by a variety of factors. The most widely used starting material is chemical grade trioxide ($MoO_3$), although the dioxide ($MoO_2$), and ammonium dimolybdate ($(NH_4)_2Mo_2O_7$), are also used.

While molybdenum metal powders produced by such single- and two-stage processes may be subsequently melted (e.g., by arc-melting) to produce molybdenum metal ingots, the high melting temperature of molybdenum as well as other difficulties with arc-melting processes make such processing undesirable in most instances. Instead, molybdenum metal powders are usually subjected to a number of so-called "powder metallurgy" processes to form or produce various types of molybdenum metal articles and materials. For example, molybdenum metal powder may be compacted into bars or "compacts," that are subsequently sintered. The sintered compacts may be used "as is," or may be further processed, e.g., by swaging, forging, rolling, or drawing, to form a wide variety of molybdenum metal articles, such as wire and sheet products.

SUMMARY OF THE INVENTION

A method for producing a metal article according to one embodiment of the invention may involve the steps of: Providing a composite metal powder including a substantially homogeneous dispersion of molybdenum and molybdenum disulfide sub-particles that are fused together to form individual particles of the composite metal powder. The molybdenum/molybdenum disulfide composite metal powder is then compressed under sufficient pressure to cause the mixture to behave as a nearly solid mass. The invention also encompasses metal articles produced by this process.

Also disclosed is a method for producing a composite metal powder that includes the steps of: Providing a supply of molybdenum metal powder; providing a supply of molybdenum disulfide powder; combining the molybdenum metal powder and the molybdenum disulfide powder with a liquid to form a slurry; feeding the slurry into a stream of hot gas; and recovering the composite metal powder, the composite metal powder comprising a substantially homogeneous dispersion of molybdenum and molybdenum disulfide sub-particles that are fused together to form individual particles of the composite metal powder.

BRIEF DESCRIPTION OF THE DRAWINGS

Illustrative and presently preferred exemplary embodiments of the invention are shown in the drawings in which.

DETAILED DESCRIPTION OF THE PREFERRED EMBODIMENTS

Figure 1:
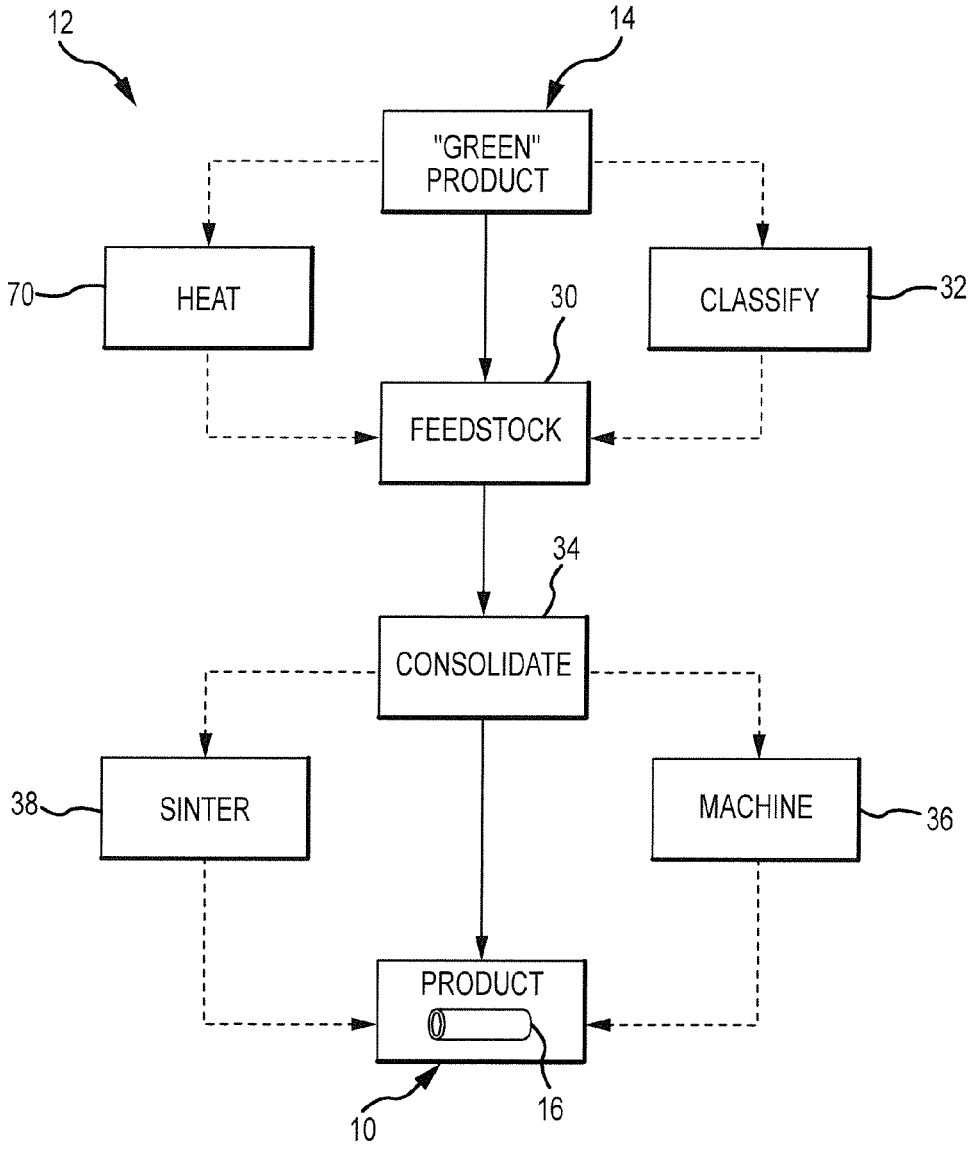
FIG. 1 is a process flow chart of basic process steps in one embodiment of a method for producing metal articles according to the present invention.

Solid parts or metal articles 10 primarily comprising molybdenum and molybdenum disulfide ($Mo/MoS_2$) as well methods 12 for producing the metal articles 10 are shown in FIG. 1. The metal articles 10 are produced or formed by consolidating or compacting a composite metal powder 14 comprising molybdenum and molybdenum disulfide. As will be described in much greater detail herein, the metal articles 10 exhibit significant improvements in various tribological parameters (e.g., friction coefficient and wear) compared to plain molybdenum parts. Accordingly, the $Mo/MoS_2$ metal articles 10 of the present invention may be used in a wide range of applications and for a wide range of primary purposes.

Figure 2:
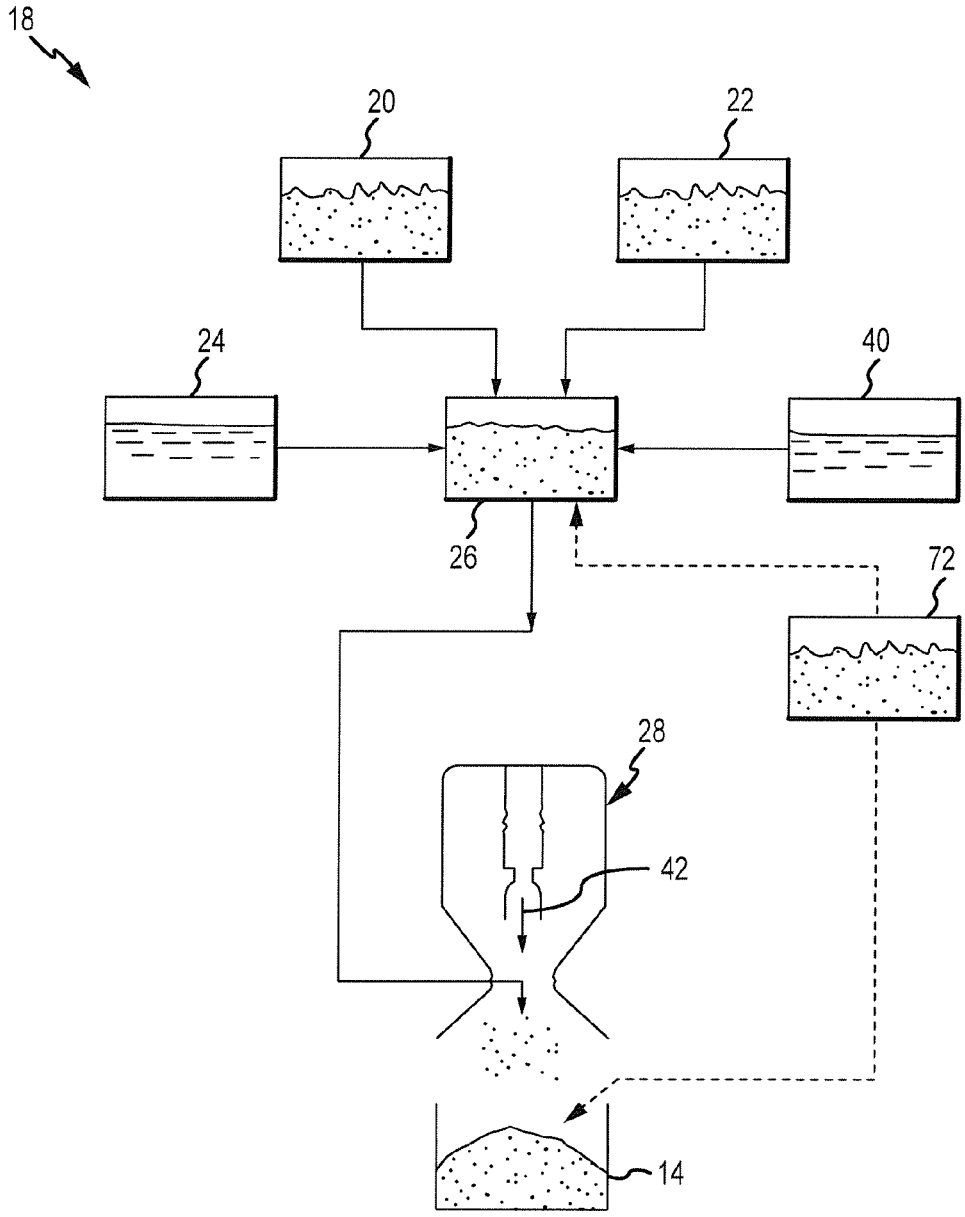
FIG. 2 is a process flow chart of basic process steps in one embodiment of a method for producing a molybdenum/molybdenum disulfide composite metal powder.

The composite metal powder 14 used to make the metal articles 10 may be produced by a process or method 18 illustrated in FIG. 2. Briefly described, the process 18 may comprise providing a supply of a molybdenum metal (Mo) powder 20 and a supply of a molybdenum disulfide ($MoS_2$) powder 22. The molybdenum metal powder 20 and molybdenum disulfide powder 22 are combined with a liquid 24, such as water, to form a slurry 26. The slurry 26 may then be spray dried in a spray dryer 28 in order to produce the molybdenum/molybdenum disulfide composite metal powder 14.

Figure 3:
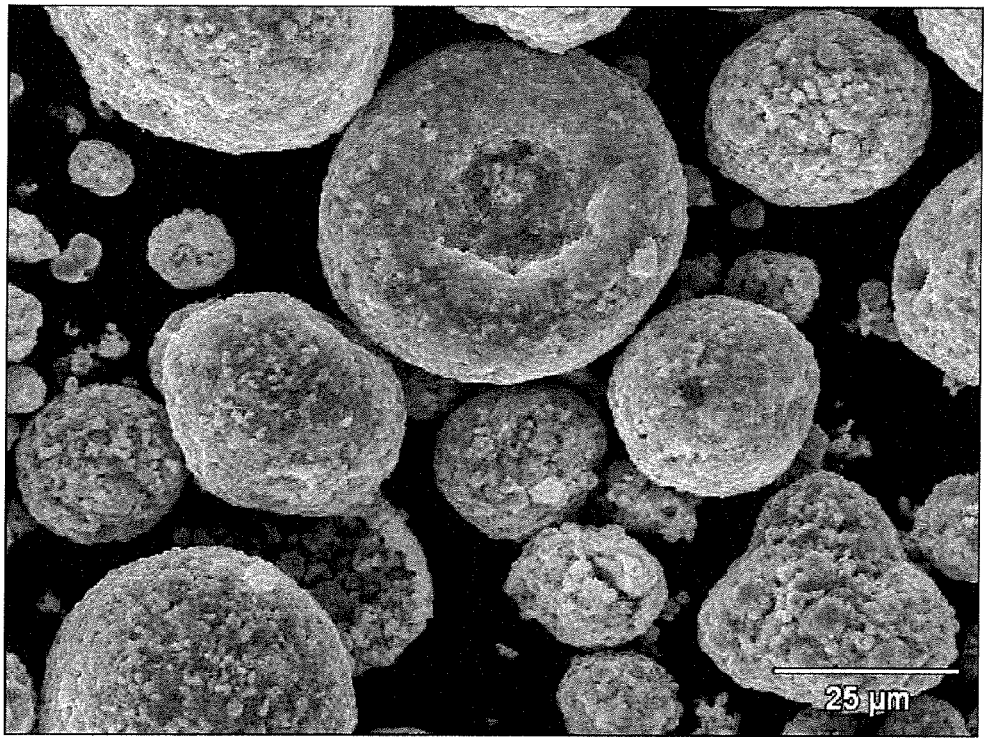
FIG. 3 is a scanning electron microscope image of a molybdenum/molybdenum disulfide composite metal powder.

Referring now to FIG. 3, the molybdenum/molybdenum disulfide composite metal powder 14 comprises a plurality of generally spherically-shaped particles that are themselves agglomerations of smaller particles. The molybdenum disulfide is highly dispersed within the molybdenum. That is, the molybdenum/molybdenum disulfide composite metal powder 14 of the present invention is not a mere combination of molybdenum disulfide powders and molybdenum metal powders. Rather, the composite metal powder 14 comprises a substantially homogeneous mixture of molybdenum and molybdenum disulfide on a particle-by-particle basis. Stated another way, the individual spherical powder particles comprise sub-particles of molybdenum and molybdenum disulfide that are fused together, so that individual particles of the composite metal powder 14 comprise both molybdenum and molybdenum disulfide, with each particle containing approximately the same amount of molybdenum disulfide.

The composite metal powder 14 is also of high density and possesses favorable flow characteristics. For example, and as will be discussed in further detail herein, exemplary molybdenum/molybdenum disulfide composite metal powders 14 produced in accordance with the teachings provided herein may have Scott densities in a range of about 2.3 g/cc to about 2.6 g/cc. The composite metal powders 16 are also quite flowable, typically exhibiting Hall flowabilities as low as 20 s/50 g for the various example compositions shown and described herein. However, other embodiments may not be flowable until screened or classified.

Referring back now primarily to FIG. 1, the molybdenum/molybdenum disulfide composite metal powder 14 may be used in its as-recovered or "green" form as a feedstock 30 to produce the metal articles 10. Alternatively, the "green" composite metal powder 14 may be further processed, e.g., by screening or classification 32, by heating 70, or by combinations thereof, before being used as feedstock 30, as will be described in greater detail herein. The molybdenum/molybdenum disulfide composite metal powder feedstock 30 (e.g., in either the "green" form or in the processed form) may be compacted or consolidated at step 34 in order to produce a metal article 10. By way of example, in one embodiment, metal article 10 may comprise a plain bearing 16. As will be described in further detail herein, the consolidation process 34 may comprise axial pressing, hot isostatic pressing (HIPing), warm isostatic pressing (WIPing), cold isostatic pressing (CIPing), and sintering.

The metal article 10 may be used "as is" directly from the consolidation process 34. Alternatively, the consolidated metal article 10 may be further processed, e.g., by machining 36, by sintering 38, or by combinations thereof, in which case the metal article 10 will comprise a processed metal article.

As will be described in greater detail herein, certain properties or material characteristics of the metal articles 10 (e.g., a plain bearing 16) of the present invention may be varied somewhat by changing the relative proportions of molybdenum and molybdenum disulfide in the composite metal powder 14 that is used to fabricate the metal articles 10. For example, the structural strength of metal articles 10 may be increased by decreasing the concentration of molybdenum disulfide in the composite metal powder 14. Conversely, the lubricity of such metal articles 10 may be increased by increasing the concentration of molybdenum disulfide. Such increased lubricity may be advantageous in situations wherein the metal articles 10 are to be used to provide "transfer" lubrication. Various properties and material characteristics of the metal articles 10 may also be varied by adding various alloying compounds, such as nickel and/or nickel alloys, to the composite metal powder 14, as also will be explained in greater detail below.

A significant advantage of metal articles 10 produced in accordance with the teachings of the present invention is that they exhibit low wear rates and low coefficients of friction compared to plain molybdenum parts fabricated in accordance with conventional methods. The metal articles 10 of the present invention also form beneficial tribocouples with commonly-used metals and alloys, such as cast iron, steel, stainless steel, and tool steel. Beneficial tribocouples may also be formed with various types of high-temperature metal alloys, such as titanium alloys and various high-temperature alloys sold under the HAYNES® and HASTELLOY® trademarks. Therefore, metal articles 10 of the present invention will be well-suited for use in a wide variety of applications where tribocouples having beneficial characteristics, such as lower friction and wear rates compared to conventionally available materials, would be desirable or advantageous.

In addition, metal articles 10 according to the present invention may be fabricated with varying material properties and characteristics, such as hardness, strength, and lubricity, thereby allowing metal articles 10 to be customized or tailored to specific requirements or applications. For example, metal articles 10 having increased hardness and strength may be produced from molybdenum/molybdenum disulfide composite powder mixtures 14 (i.e., feedstocks 30) having lower amounts of molybdenum disulfide. Metal articles 10 having such increased hardness and strength would be suitable for use as base structural materials, while still maintaining favorable tribocouple characteristics. Moreover, and as will be described in further detail herein, additional hardness and strength may be imparted to the metal articles by mixing the molybdenum/molybdenum disulfide composite metal powder 14 with additional alloying agents, such as nickel and various nickel alloys.

Metal articles 10 having increased lubricity may be formed from composite metal powders 14 (i.e., feedstocks 30) having higher concentrations of molybdenum disulfide. Metal articles 10 having such increased lubricity may be advantageous for use in applications wherein "transfer" lubrication is to be provided by the metal article 10, but where high structural strength and/or hardness may be of less importance.

Still other advantages are associated with the composite powder product 14 used as the feedstock 30 for the metal articles 10. The molybdenum/molybdenum disulfide composite powder product 14 disclosed herein provides a substantially homogeneous combination, i.e., even dispersion, of molybdenum and molybdenum disulfide that is otherwise difficult or impossible to achieve by conventional methods.

Moreover, even though the molybdenum/molybdenum disulfide composite metal powder comprises a powdered material, it is not a mere mixture of molybdenum and molybdenum disulfide particles. Instead, the molybdenum and molybdenum disulfide sub-particles are actually fused together, so that individual particles of the powdered metal product comprise both molybdenum and molybdenum disulfide. Accordingly, powdered feedstocks 30 comprising the molybdenum/molybdenum disulfide composite powders 14 according to the present invention will not separate (e.g., due to specific gravity differences) into molybdenum particles and molybdenum disulfide particles.

Besides the advantages associated with the ability to provide a composite metal powder wherein molybdenum disulfide is highly and evenly dispersed throughout molybdenum (i.e., homogeneous), the composite metal powders 14 disclosed herein are also characterized by high densities and flowabilities, thereby allowing the composite metal powders 14 to be used to advantage in a wide variety of powder compaction or consolidation processes, such as cold, warm, and hot isostatic pressing processes as well as axial pressing and sintering processes. The high flowability allows the composite metal powders 14 disclosed herein to readily fill mold cavities, whereas the high densities minimizes shrinkage that may occur during subsequent sintering processes.

Having briefly described the metal articles 10, the methods 12 for producing them, as well as the composite metal powders 14 that may be used to make the metal articles 10, various embodiments of the metal articles, processes for making them, and processes for producing the molybdenum/molybdenum disulfide composite metal powders 14 will now be described in detail.

Referring back now to FIG. 1, molybdenum/molybdenum disulfide metal articles 10 according to the present invention may be formed or produced by compacting or consolidating 34 a feedstock material 30 comprising a molybdenum/molybdenum disulfide composite metal powder 14. As mentioned above, the feedstock material 30 may comprise a "green" molybdenum/molybdenum disulfide composite metal powder 14, i.e., substantially as produced by method 18 of FIG. 2. Alternatively, the green molybdenum/molybdenum disulfide composite metal powder 14 may be classified, e.g., at step 32, to tailor the distribution of particle sizes of the feedstock material 30 to a desired size or range of sizes.

Composite metal powders 14 suitable for use herein may comprise any of a wide range of particle sizes and mixtures of particle sizes, so long as the particle sizes allow the composite metal powder 14 to be compressed (e.g., by the processes described herein) to achieve the desired material characteristics (e.g., strength and/or density) desired for the final metal article or compact 10. Generally speaking, acceptable results can be obtained with powder sizes in the following ranges:

TABLE I

| Mesh Size | Weight Percent |
|---|---|
| +200 | 10%-40% |
| −200/+325 | 25%-45% |
| −325 | 25%-55% |

As mentioned above, it may be desirable or advantageous to classify the green composite powder 14 before it is consolidated at step 34. Factors to be considered include, but are not limited to, the particular metal article 10 that is to be produced, the desired or required material characteristics of the metal article (e.g., density, hardness, strength, etc.) as well as the particular consolidation process 34 that is to be used.

The desirability and/or necessity to first classify the green composite powder 14 will also depend on the particular particle sizes of the green composite powder 14 produced by the process 18 of FIG. 2. That is, depending on the particular process parameters that are used to produce the green composite powder (exemplary embodiments of which are described herein), it may be possible or even advantageous to use the composite powder in its green form. Alternatively, of course, other considerations may indicate the desirability of first classifying the green composite powder 14.

In summation, then, because the desirability and/or necessity of classifying the composite powder 14 will depend on a wide variety of factors and considerations, some of which are described herein and others of which will become apparent to persons having ordinary skill in the art after having become familiar with the teachings provided herein, the present invention should not be regarded as requiring a classification step 32.

The composite metal powder 14 may also be heated, e.g., at step 70, if required or desired. Such heating 70 of the composite metal powder 14 may be used to remove any residual moisture and/or volatile material that may remain in the composite metal powder 14. In some instances, heating 70 of the composite metal powder 14 may also have the beneficial effect of increasing the flowability of the composite metal powder 14.

With reference now primarily to FIG. 2, the molybdenum/molybdenum disulfide composite metal powder 14 may be prepared in accordance with a method 18. Method 18 may comprise providing a supply of molybdenum metal powder 20 and a supply of molybdenum disulfide powder 22. The molybdenum metal powder 20 may comprise a molybdenum metal powder having a particle size in a range of about 0.5 μm to about 25 μm, although molybdenum metal powders 20 having other sizes may also be used. Molybdenum metal powders suitable for use in the present invention are commercially available from Climax Molybdenum, a Freeport-McMoRan Company, and from Climax Molybdenum Company, a Freeport-McMoRan Company, Ft. Madison Operations, Ft. Madison, Iowa (US). By way of example, in one embodiment, the molybdenum metal powder 20 comprises molybdenum metal powder from Climax Molybdenum Company sold under the name "FM1." Alternatively, molybdenum metal powders from other sources may be used as well.

The molybdenum disulfide powder 22 may comprise a molybdenum disulfide metal powder having a particle size in a range of about 0.1 μm to about 30 μm. Alternatively, molybdenum disulfide powders 22 having other sizes may also be used. Molybdenum disulfide powders 22 suitable for use in the present invention are commercially available from Climax Molybdenum, a Freeport-McMoRan Company, and from Climax Molybdenum Company, a Freeport-McMoRan Company, Ft. Madison Operations, Ft. Madison, Iowa (US). Suitable grades of molybdenum disulfide available from Climax Molybdenum Company include "technical," "technical fine," and "Superfine Molysulfide®" grades. By way of example, in one embodiment, the molybdenum disulfide powder 22 comprises "Superfine Molysulfide®" molybdenum disulfide powder from Climax Molybdenum Company. Alternatively, molybdenum disulfide powders of other grades and from other sources may be used as well.

The molybdenum metal powder 20 and molybdenum disulfide powder 22 may be mixed with a liquid 24 to form a slurry 26. Generally speaking, the liquid 24 may comprise deionized water, although other liquids, such as alcohols, volatile liquids, organic liquids, and various mixtures thereof, may also be used, as would become apparent to persons having ordinary skill in the art after having become familiar with the teachings provided herein. Consequently, the present invention should not be regarded as limited to the particular liquids 24 described herein. However, by way of example, in one embodiment, the liquid 24 comprises deionized water.

In addition to the liquid 24, a binder 40 may be used as well, although the addition of a binder 40 is not required. Binders 40 suitable for use in the present invention include, but are not limited to, polyvinyl alcohol (PVA). The binder 40 may be mixed with the liquid 24 before adding the molybdenum metal powder 20 and the molybdenum disulfide powder 22. Alternatively, the binder 40 could be added to the slurry 26, i.e., after the molybdenum metal 20 and molybdenum disulfide powder 22 have been combined with liquid 24.

The slurry 26 may comprise from about 15% to about 50% by weight total liquid (about 21% by weight total liquid typical) (e.g., either liquid 24 alone, or liquid 24 combined with binder 40), with the balance comprising the molybdenum metal powder 20 and the molybdenum disulfide powder 22 in the proportions described below.

As was briefly described above, certain properties or material characteristics of the final metal article 10 may be varied or adjusted by changing the relative proportions of molybdenum and molybdenum disulfide in the composite metal powder 14. Generally speaking, the structural strength of the metal articles may be increased by decreasing the concentration of molybdenum disulfide in the composite metal powder 14. Conversely, the lubricity of the final metal articles 10 may be increased by increasing the concentration of molybdenum disulfide in the composite metal powder 14. Additional factors that may affect the amount of molybdenum disulfide powder 22 that is to be provided in slurry 26 include, but are not limited to, the particular "downstream" processes that may be employed in the manufacture of the metal article 10. For example, certain downstream processes, such as heating and sintering processes, may result in some loss of molybdenum disulfide in the final metal article 10, which may be compensated by providing additional amounts of molybdenum disulfide in the slurry 26.

Consequently, the amount of molybdenum disulfide powder 22 that may be used to form the slurry 26 may need to be varied or adjusted to provide the composite metal powder 14 and/or final metal article 10 with the desired amount of "retained" molybdenum disulfide (i.e., to provide the metal article 10 with the desired strength and lubricity). Furthermore, because the amount of retained molybdenum disulfide may vary depending on a wide range of factors, many of which are described herein and others of which would become apparent to persons having ordinary skill in the art after having become familiar with the teachings provided herein, the present invention should not be regarded as limited to the provision of the molybdenum disulfide powder 22 in any particular amounts.

By way of example, the mixture of molybdenum metal powder 20 and molybdenum disulfide powder 22 may comprise from about 1% by weight to about 50% by weight molybdenum disulfide powder 22, with molybdenum disulfide in amounts of about 15% by weight being typical. In some embodiments, molybdenum disulfide powder 22 may be added in amounts in excess of 50% by weight without departing from the spirit and scope of the present invention. It should be noted that these weight percentages are exclusive of the liquid component(s) later added to form the slurry 26. That is, these weight percentages refer only to the relative quantities of the powder components 20 and 22.

Overall, then, slurry 26 may comprise from about 15% by weight to about 50% by weight liquid 24 (about 18% by weight typical), which may include from about 0% by weight (i.e., no binder) to about 10% by weight binder 44 (about 3% by weight typical). The balance of slurry 26 may comprise the metal powders (e.g., molybdenum metal powder 20, molybdenum disulfide powder 22, and, optionally, supplemental metal powder 46) in the proportions specified herein.

Depending on the particular application for the metal article 10, it may be desirable to add a supplemental metal powder 72 to the slurry 26. See FIG. 2. Generally speaking, the addition of a supplemental metal powder 72 may be used to increase the strength and/or hardness of the resulting metal article 10, which may be desired or required for the particular application. Exemplary supplemental metal powders 72 include nickel metal powders, nickel alloy powders, and mixtures thereof. Alternatively, other metal powders may also be used.

In one embodiment, the supplemental metal powder 72 may comprise a nickel alloy powder having a particle size in a range of about 1 μm to about 100 μm, although supplemental metal powders 72 having other sizes may also be used. By way of example, in one embodiment, the supplemental metal powder 72 comprises "Deloro 60®" nickel alloy powder, which is commercially available from Stellite Coatings of Goshen Indiana (US). "Deloro 60®" is a trademark for a nickel alloy powder comprising various elements in the following amounts (in weight percent): Ni(bal.), Fe(4), B(3.1-3.5), C(0.7), Cr(14-15), Si(2-4.5). Alternatively, nickel alloy metal powders having other compositions and available from other sources may be used as well.

If used, the supplemental metal powder 72 may be added to the slurry 26, as best seen in FIG. 2. Alternatively, supplemental metal powder 72 may be added to the composite powder product 14 (i.e., after spray drying). However, it will be generally preferred to add the supplemental metal powder 72 to the slurry 26.

The supplemental metal powder may be added to the mixture of molybdenum powder 20 and molybdenum disulfide powder (i.e., a dry powder mixture) in amounts up to about 50% by weight. In one embodiment wherein the supplemental metal powder 72 comprises a nickel or nickel alloy metal powder (e.g., Deloro 60®), then the supplemental nickel alloy metal powder may comprise about 25% by weight (exclusive of the liquid component). In this example it should be noted that higher concentrations of nickel in the final metal article product 10 will generally provide for increased hardness. In some instances, the addition of nickel alloy powder may also result in a slight decrease in the friction coefficient of metal article 10.

After being prepared, slurry 26 may be spray dried (e.g., in spray dryer 28) to produce the composite metal powder product 14. By way of example, in one embodiment, the slurry 26 is spray dried in a pulse combustion spray dryer 28 of the type shown and described in U.S. Pat. No. 7,470,307, of Larink, Jr., entitled "Metal Powders and Methods for Producing the Same," which is specifically incorporated herein by reference for all that it discloses.

In one embodiment, the spray dry process involves feeding slurry 26 into the pulse combustion spray dryer 28. In the spray dryer 28, slurry 26 impinges a stream of hot gas (or gases) 42, which are pulsed at or near sonic speeds. The sonic pulses of hot gas 42 contact the slurry 26 and drive-off substantially all of the liquid (e.g., water and/or binder) to form the composite metal powder product 14. The temperature of the pulsating stream of hot gas 42 may be in a range of about 300° C. to about 800° C., such as about 465° C. to about 537° C., and more preferably about 565° C.

Figure 4:
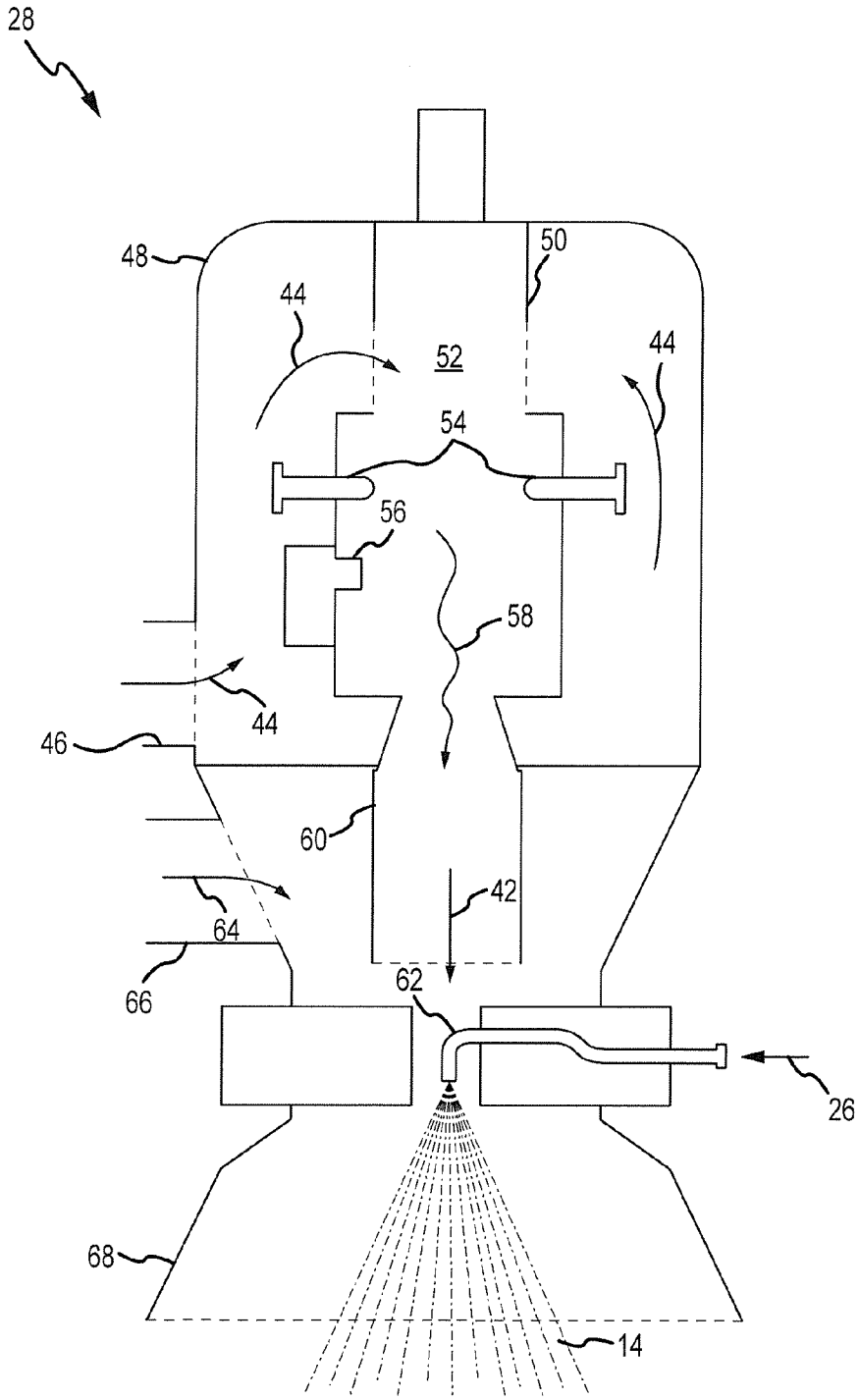
FIG. 4 is a schematic representation of one embodiment of pulse combustion spray dry apparatus that may be used to produce the molybdenum/molybdenum disulfide composite metal powder.

More specifically, and with reference now primarily to FIG. 4, combustion air 44 may be fed (e.g., pumped) through an inlet 46 of spray dryer 28 into the outer shell 48 at low pressure, whereupon it flows through a unidirectional air valve 50. The air 44 then enters a tuned combustion chamber 52 where fuel is added via fuel valves or ports 54. The fuel-air mixture is then ignited by a pilot 56, creating a pulsating stream of hot combustion gases 58 which may be pressurized to a variety of pressures, e.g., in a range of about 0.003 MPa (about 0.5 psi) to about 0.2 MPa (about 3 psi) above the combustion fan pressure. The pulsating stream of hot combustion gases 58 rushes down tailpipe 60 toward the atomizer 62. Just above the atomizer 62, quench air 64 may be fed through an inlet 66 and may be blended with the hot combustion gases 58 in order to attain a pulsating stream of hot gases 42 having the desired temperature. The slurry 26 is introduced into the pulsating stream of hot gases 42 via the atomizer 62. The atomized slurry may then disperse in the conical outlet 68 and thereafter enter a conventional tall-form drying chamber (not shown). Further downstream, the composite metal powder product 14 may be recovered using standard collection equipment, such as cyclones and/or baghouses (also not shown).

In pulsed operation, the air valve 50 is cycled open and closed to alternately let air into the combustion chamber 52 for the combustion thereof. In such cycling, the air valve 50 may be reopened for a subsequent pulse just after the previous combustion episode. The reopening then allows a subsequent air charge (e.g., combustion air 44) to enter. The fuel valve 54 then re-admits fuel, and the mixture auto-ignites in the combustion chamber 52, as described above. This cycle of opening and closing the air valve 50 and combusting the fuel in the chamber 52 in a pulsing fashion may be controllable at various frequencies, e.g., from about 80 Hz to about 110 Hz, although other frequencies may also be used.

The "green" molybdenum/molybdenum disulfide composite metal powder product 14 produced by the pulse combustion spray dryer 28 described herein is illustrated in FIG. 3 and comprises a plurality of generally spherically-shaped particles that are themselves agglomerations of smaller particles. As already described, the molybdenum disulfide is highly dispersed within the molybdenum, so that the composite powder 14 comprises a substantially homogeneous dispersion or composite mixture of molybdenum disulfide and molybdenum sub-particles that are fused together.

Generally speaking, the composite metal powder product 14 produced in accordance with the teachings provided herein will comprise a wide range of sizes, and particles having sizes ranging from about 1 μm to about 500 μm, such as, for example, sizes ranging from about 1 μm to about 100 μm, can be readily produced by the following the teachings provided herein. The composite metal powder product 14 may be classified e.g., at step 32 (FIG. 1), if desired, to provide a product 14 having a more narrow size range. Sieve analyses of various exemplary "green" composite metal powder products 14 are provided in Table V.

As mentioned above, the molybdenum/molybdenum disulfide composite metal powder 14 is also of high density and is generally quite flowable. Exemplary composite metal powder products 14 have Scott densities (i.e., apparent densities) in a range of about 2.3 g/cc to about 2.6 g/cc. In some embodiments, Hall flowabilities may be as low (i.e., more flowable) as 20 s/50 g. However, in other embodiments, the composite metal powder 16 may not be flowable unless screened or classified.

As already described, the pulse combustion spray dryer 28 provides a pulsating stream of hot gases 42 into which is fed the slurry 26. The contact zone and contact time are very short, the time of contact often being on the order of a fraction of a microsecond. Thus, the physical interactions of hot gases 42, sonic waves, and slurry 26 produces the composite metal powder product 14. More specifically, the liquid component 24 of slurry 26 is substantially removed or driven away by the sonic (or near sonic) pulse waves of hot gas 42. The short contact time also ensures that the slurry components are minimally heated, e.g., to levels on the order of about 115° C. at the end of the contact time, temperatures which are sufficient to evaporate the liquid component 24.

However, in certain instances, residual amounts of liquid (e.g., liquid 24 and/or binder 40, if used) may remain in the resulting "green" composite metal powder product 14. Any remaining liquid 24 may be driven-off (e.g., partially or entirely), by a subsequent heating process or step 70. See FIG. 1. Generally speaking, the heating process 70 should be conducted at moderate temperatures in order to drive off the liquid components, but not substantial quantities of molybdenum disulfide. Some molybdenum disulfide may be lost during heating 70, which will reduce the amount of retained molybdenum disulfide in the heated feedstock product 30. As a result, it may be necessary to provide increased quantities of molybdenum disulfide powder 22 to compensate for any expected loss, as described above.

Heating 70 may be conducted at temperatures within a range of about 90° C. to about 120° C. (about 110° C. preferred). Alternatively, temperatures as high as 300° C. may be used for short periods of time. However, such higher temperatures may reduce the amount of retained molybdenum disulfide in the final metal product 10. In many cases, it may be preferable to conduct the heating 30 in a hydrogen atmosphere in order to minimize oxidation of the composite metal powder 14.

It may also be noted that the agglomerations of the metal powder product 14 preferably retain their shapes (in many cases, substantially spherical), even after the heating step 70. In fact, heating 70 may, in certain embodiments, result in an increase in flowability of the composite metal powder 14.

As noted above, in some instances a variety of sizes of agglomerated particles comprising the composite metal powder 14 may be produced during the spray drying process. It may be desirable to further separate or classify the composite metal powder product 14 into a metal powder product having a size range within a desired product size range. For example, most of the composite metal powder 14 produced will comprise particle sizes in a wide range (e.g., from about 1 μm to about 500 μm), with substantial amounts (e.g., in a range of 40-50 wt. %) of product being smaller than about 45 μm (i.e., −325 U.S. mesh). Significant amounts of composite metal powder 14 (e.g., in a range of 30-40 wt. %) may be in the range of about 45 μm to 75 μm (i.e., −20+325 U.S. mesh).

The processes described herein may yield a substantial percentage of product in this product size range; however, there may be remainder products, particularly the smaller products, outside the desired product size range which may be recycled through the system, though liquid (e.g., water) would again have to be added to create an appropriate slurry composition. Such recycling is an optional alternative (or additional) step or steps.

Once the molybdenum/molybdenum disulfide composite powder 14 has been prepared, it may be used as a feedstock material 30 in the process 12 illustrated in FIG. 1 to produce a metal article 10. More specifically, the composite metal powder 14 may be used in its as-recovered or "green" form as feedstock 30 for a variety of processes and applications, several of which are shown and described herein, and others of which will become apparent to persons having ordinary skill in the art after having become familiar with the teachings provided herein. Alternatively, the "green" composite metal powder product 14 may be further processed, such as, for example, by classification 32, by heating 70 and/or by combinations thereof, as described above, before being used as feedstock 30.

The feedstock material 30 (i.e., comprising either the green composite powder product 14 or a heated/classified powder product) may then be compacted or consolidated at step 34 to produce the desired metal article 10 or a "blank" compact from which the desired metal article 10 may be produced. Consolidation processes 34 that may be used with the present invention include, but are not limited to, axial pressing, hot isostatic pressing (HIPing), warm isostatic pressing (WIPing), cold isostatic pressing (CIPing), and sintering. Generally speaking, composite powders 14 prepared in accordance with the teachings provided herein may be consolidated so that the resulting "green" metal articles or compacts 10 will have green densities in a range of about 6.0 g/cc to about 7.0 g/cc (about 6.4 g/cc typical).

Axial pressing may be performed at a wide range of pressures depending on a variety of factors, including the size and shape of the particular metal article or compact 10 that is to be produced as well as on the strength and/or density desired for the metal article or compact 10. Consequently, the present invention should not be regarded as limited to any particular compaction pressure or range of compaction pressures. However, by way of example, in one embodiment, when compressed under a pressure of about in the range of about 310 MPa to about 470 MPa (about 390 MPa preferred), composite powders 14 prepared in accordance with the teachings provided herein will acquire green strengths and densities in the ranges described herein.

Cold, warm, and hot isostatic pressing processes involve the application of considerable pressure and heat (in the cases of warm and hot isostatic pressing) in order to consolidate or form the composite metal powder feedstock material 24 into the desired shape. Generally speaking, pressures for cold, warm and hot isostatic processes should be selected so as to provide the resulting compacts with green densities in the ranges specified herein.

Hot isostatic pressing processes may be conducted at the pressures specified herein and at any of a range of suitable temperatures, again depending on the green density of the molybdenum/molybdenum disulfide composite metal powder compact. However, it should be noted that some amount of molybdenum disulfide may be lost at higher temperatures. Consequently, the temperatures may need to be moderated to ensure that the final metal article or compact 10 contains the desired quantity of retained molybdenum disulfide.

Warm isostatic pressing processes may be conducted at the pressures specified herein. Temperatures for warm isostatic pressing will generally be below temperatures for hot isostatic pressing.

Sintering may be conducted at any of a range of temperatures. The particular temperatures that may be used for sintering will depend on a variety of factors, including the desired density for the final metal article 10, as well as amount of molybdenum disulfide that is desired to be retained in the metal article or compact 10.

After consolidation 34, the resulting metal product 10 (e.g., plain bearing 16) may be used "as is" or may be further processed if required or desired. For example, the metal product 10 may be machined at step 38 if necessary or desired before being placed in service. Metal product 10 may also be heated or sintered at step 38 in order to further increase the density and/or strength of the metal product 10. It may be desirable to conduct such a sintering process 38 in a hydrogen atmosphere in order to minimize the likelihood that the metal product 10 will become oxidized. Generally speaking, it will be preferred to conduct such heating at temperatures sufficiently low so as to avoid substantial reductions in the amount of retained molybdenum disulfide in the final product.

EXAMPLES

Two different slurry mixtures 26 were prepared that were then spray dried to produce composite metal powders 14. More specifically, the two slurry mixtures were spray dried in five (5) separate spray dry trials or "runs" to produce five different powder preparations, designated as "Runs 1-5." The first slurry mixture 26 was used to produce the Runs 1-3 powder preparations, whereas the second slurry mixture was used to produce the Runs 4 and 5 powder preparations.

The powder preparations were then analyzed, the results of which are presented in Tables IV and V. The Run 1 powder preparation was then consolidated (i.e., by axial pressing) to form powder compacts or metal articles 10 that were then analyzed. The results of the analysis of the metal articles 10 are presented in Table VI. The metal articles 10 exhibited significant reductions in friction coefficient, surface roughness, and wear compared to plain molybdenum pressed parts.

Referring now to Table II, two slurry compositions were prepared. The first slurry composition was used in the first three (3) spray dry trials produce three different powder preparations, designated as the Runs 1-3 preparations. The second slurry composition was spray dried in two subsequent spray dry trials to produce two additional powder preparations, designated herein as the Runs 4 and 5 preparations.

Each slurry composition comprised about 18% by weight liquid 24 (e.g., as deionized water), about 3% by weight binder (e.g., as polyvinyl alcohol), with the remainder being molybdenum metal and molybdenum disulfide powders 20 and 22. The molybdenum powder 20 comprised "FM1" molybdenum metal powder, whereas the molybdenum disulfide powder 22 comprised "Superfine Molysulfide®," both of which were obtained from Climax Molybdenum Company, as specified herein. The ratio of molybdenum metal powder 20 to molybdenum disulfide powder 22 was held relatively constant for both slurry compositions, at about 14-15% by weight molybdenum disulfide (exclusive of the liquid component).

TABLE II

| Run | Water kg (lbs) | Binder kg (lbs) | $MoS_2$ Powder kg (lbs) | Mo Powder kg (lbs) |
|---|---|---|---|---|
| 1-3 | 33.1 (73) | 5.4 (12) | 21 (47) | 128 (283) |
| 4,5 | 16.8 (37) | 2.7 (6) | 10.5 (23) | 64 (141) |

The slurries 26 were then fed into the pulse combustion spray dryer 28 in the manner described herein to produce five (5) different composite metal powder 14 batches or preparations, designated herein as Runs 1-5. The temperature of the pulsating stream of hot gases 42 was controlled to be within a range of about 548° C. to about 588° C. The pulsating stream of hot gases 42 produced by the pulse combustion spray dryer 28 substantially drove-off the water and binder from the slurry 26 to form the composite powder product 14. Various operating parameters for the pulse combustion spray dryer 28 for the various trials (i.e., Runs 1-5) are set forth in Table III:

TABLE III

| Run | 1 | 2 | 3 | 4 | 5 |
|---|---|---|---|---|---|
| Nozzle | T_Open | T_Open | T_Open | T_Open | T_Open |
| Venturi Size, mm | 35 | 35 | 38.1 | 38.1 | 38.1 |
| (inches) | (1.375) | (1.375) | (1.5 S) | (1.5 S) | (1.5 C) |
| Venturi Position | 4 | 4 | Std. | Std. | Std. |
| Heat Release, kJ/hr | 88,625 | 84,404 | 88,625 | 88,625 | 88,625 |
| (btu/hr) | (84,000) | (80,000) | (84,000) | (84,000) | (84,000) |
| Fuel Valve, (%) | 36.0 | 34.5 | 36.0 | 36.0 | 36.0 |
| Contact Temp., ° C. | 579 | 588 | 553 | 548 | 563 |
| (° F.) | (1,075) | (1,091) | (1,027) | (1,019) | (1,045) |
| Exit Temp., ° C. (° F.) | 121 | 116 | 116 | 116 | 116 |
| | (250) | (240) | (240) | (240) | (240) |
| Outside Temp., ° C. | 24 | 24 | 23 | 16 | 18 |
| (° F.) | (75) | (75) | (74) | (60) | (65) |
| Baghouse ΔP, mm $H_2O$ | 12.4 | 8.9 | 20.8 | 7.6 | 9.1 |
| (inches $H_2O$) | (0.49) | (0.35) | (0.82) | (0.30) | (0.36) |
| Turbo Air, MPa (psi) | 0.197 | 0.134 | 0.130 | 0.149 | 0.139 |
| | (28.5) | (19.5) | (18.8) | (21.6) | (20.2) |
| RAV, (%) | 85 | 85 | 85 | 85 | 85 |
| Ex. Air Setpoint, (%) | 60 | 60 | 60 | 60 | 60 |
| Comb. Air Setpoint, (%) | 60 | 55 | 55 | 45 | 55 |
| Quench Air Setpoint, (%) | 40 | 35 | 35 | 35 | 35 |
| Trans. Air Setpoint, (%) | 5 | 5 | 5 | 5 | 5 |
| Feed Pump, (%) | 5.2 | 6.1 | 6.0 | 6.6 | 6.3 |
| Comb. Air Pressure, | 0.010 | 0.008 | 0.008 | 0.006 | 0.009 |
| MPa (psi) | (1.49) | (1.19) | (1.17) | (0.86) | (1.28) |

TABLE III-continued

| Run | 1 | 2 | 3 | 4 | 5 |
|---|---|---|---|---|---|
| Quench Air Pressure, MPa (psi) | 0.009 (1.30) | 0.008 (1.10) | 0.005 (0.70) | 0.005 (0.72) | 0.006 (0.91) |
| Combustor Can Pressure, MPa (psi) | 0.010 (1.45) | 0.007 (1.02) | 0.007 (1.01) | 0.004 (0.64) | 0.007 (1.03) |

The resulting composite powder preparations for Runs 1-5 comprised agglomerations of smaller particles that were substantially solid (i.e., not hollow) and comprised generally spherical shapes. An SEM photo of the "green" molybdenum/molybdenum disulfide composite powder 14 produced by the Run 1 powder preparation is depicted in FIG. 3. Powder assays and sieve analyses for the Run 1-5 preparations are presented in Tables IV and V.

TABLE IV

| Run | Bag | Weight kg (lbs) | Carbon (ppm) | Sulfur (wt. %) | $MoS_2$ (wt. %) |
|---|---|---|---|---|---|
| 1 | 1 | 48.3 | 6720 | 6.56 | 16.38 |
| 1 | 2 | (106.4) | 6742 | 6.67 | 16.65 |
| 2 | 1 | 38.2 | 6601 | 6.63 | 16.55 |
| 2 | 2 | (84.2) | 6691 | 6.62 | 16.53 |
| 3 | 1 | 26.6 (58.6) | 6578 | 6.43 | 16.05 |
| 4 | 1 | 19.1 (42.1) | 6600 | 6.13 | 15.30 |
| 5 | 1 | 23.4 (51.6) | 6396 | 6.11 | 15.25 |

TABLE V

| | | Weight | Sieve Analysis (US Mesh, wt. %) | | |
|---|---|---|---|---|---|
| Run | Bag | kg (lbs) | +200 | −200/+30325 | −325 |
| 1 | 1 | 48.3 | 14.2 | 41.5 | 44.3 |
| 1 | 2 | (106.4) | 11.6 | 40 | 48.4 |
| 2 | 1 | 38.2 | 20.5 | 40.9 | 38.6 |
| 2 | 2 | (84.2) | 17.4 | 39.1 | 43.5 |
| 3 | 1 | 26.6 (58.6) | 37.9 | 33.1 | 29 |
| 4 | 1 | 19.1 (42.1) | 24.1 | 25 | 50.9 |
| 5 | 1 | 23.4 (51.6) | 21.9 | 30.7 | 47.4 |

The powder assays presented in Table IV indicate that the powders produced from the second slurry (i.e., the Runs 4-5 powders) contained somewhat lower levels of molybdenum disulfide than did the powders produced from the first slurry (i.e., the Runs 1-3 powders). Moreover, the powder assays presented in Table IV also indicate that the spray dry powders contained higher levels of $MoS_2$, on a weight basis, than was present in the original powder mixtures. These discrepancy could be due, in whole or in part, to several factors, including measurement uncertainties and errors associated with the weighing of the initial slurry constituents (e.g., the molybdenum and molybdenum disulfide powders 20 and 22) as well as with the instruments used to assay the spray dried powders 14. The discrepancies could also be due to material losses in processing. For example, the cyclone separators and filters in the baghouse contained significant quantities of residual (i.e., unrecovered) composite metal product material 14 that was not analyzed for sulfur and molybdenum disulfide content. It is possible that the residual powder material contained lower quantities of molybdenum disulfide for some reason compared to the recovered material.

The $Mo/MoS_2$ composite metal powder 14 from Run 1 was compacted by a hydraulic press in a die having a diameter of about 25.4 mm (about 1-inch) die at a pressure of about 240 MPa (about 35,000 psi). The resulting compacts held their shapes well and did not delaminate after pressing. For comparison, plain molybdenum pressed parts, comprising spray dried molybdenum metal powder with no molybdenum disulfide added, were also pressed. Subsequent tribological testing revealed that the $Mo/MoS_2$ pressed parts exhibited a friction coefficient of about 0.48, compared to about 0.7 for the plain molybdenum parts.

Representative samples of the $Mo/MoS_2$ and plain molybdenum pressed parts were also subjected to wear testing. Wear testing involved reciprocating a tungsten carbide ball on the representative sample over a distance of about 10 mm (about 0.4 inch). The diameter of the ball was 10 mm (about 0.4 inch), and the reciprocation frequency 3 Hz. Forces of 1 N (about 0.2 lbs) and 5 N (about 1.1 lbs) were applied for periods of 15 and 30 minutes. The depth and width of the resulting wear scars are presented in Table VI. Profilometry data relating to surface roughness were also obtained for the two representative samples and are also presented in Table VI. In addition to the substantially reduced friction coefficients between the two types of pressed parts, the Mo/MoS, pressed parts exhibited considerably reduced surface roughness and wear.

TABLE VI

| | Surface Roughness | | Wear Scar | | Force | Time |
|---|---|---|---|---|---|---|
| Sample | Ra (μm) | Peak-to-Peak (μm) | Depth (μm) | Width (μm) | (N) | (min) |
| Mo | 0.969 | 7.659 | 32.8 | 1472.2 | 1 | 15 |
| $Mo/MoS_2$ | 0.407 | 3.28 | 2.01 | 245.5 | 1 | 15 |
| | | | 4.44 | 535 | 5 | 30 |

Having herein set forth preferred embodiments of the present invention, it is anticipated that suitable modifications can be made thereto which will nonetheless remain within the scope of the invention. The invention shall therefore only be construed in accordance with the following claims:

The invention claimed is:

1. A metal article comprising a composite metal powder compressed under sufficient pressure to cause said composite metal powder to behave as a nearly solid mass, said composite metal powder comprising a substantially homogeneous dispersion of molybdenum and molybdenum disulfide sub-particles fused together to form individual particles of said composite metal powder.

2. The metal article of claim 1, having a green density in a range of about 6.0 g/cc to about 7.0 g/cc.

3. The metal article of claim 1, having a green density of about 6.4 g/cc.

4. The metal article of claim 1, having a friction coefficient of about 0.48.

5. The metal article of claim 1, having a surface finish (Ra) of about 0.407 μm and about 3.28 μm (peak-to-peak).

6. The metal article of claim 1, having a sulfur content of about 6 percent by weight.

7. The metal article of claim 1, having a molybdenum disulfide content in a range of about 1 percent by weight to about 50 percent by weight.

8. The metal article of claim 7, having a molybdenum disulfide content of about 16 percent by weight.

9. The metal article of claim 1 having a nickel content up to about 50 percent by weight.

10. The metal article of claim 9 having a nickel content of about 25 percent by weight.

11. A metal article consisting essentially of a composite metal powder comprising a substantially homogeneous dispersion of molybdenum and molybdenum disulfide sub-particles that are fused together to form individual particles of said composite metal powder compressed under sufficient pressure to cause molybdenum/molybdenum disulfide composite metal powder to behave as a nearly solid mass.

12. A composite metal powder comprising a substantially homogeneous dispersion of molybdenum and molybdenum disulfide sub-particles that are fused together to form individual particles of said composite metal powder.

13. The composite metal powder of claim 12 comprising a Hall flowability in a range of about 20 seconds for 50 grams.

14. The composite metal powder product of claim 12 having a Scott density in a range of about 2.3 g/cc to about 2.6 g/cc.

15. The composite metal powder product of claim 12, comprising from about 1 percent by weight to about 50 percent by weight molybdenum disulfide.

16. The composite metal powder product of claim 12 wherein said individual particles comprising said composite metal powder product have sizes in a range of about 1 μm to about 500 μm.

17. The composite metal powder product of claim 16 wherein said individual particles comprising said composite metal powder product have sizes in a range of about 1 μm to about 100 μm.

18. The composite metal powder product of claim 16 wherein said individual particles comprising said composite metal powder product have sizes in a range of about 45 μm to about 75 μm.

* * * * *